US012402759B2

(12) United States Patent
Weber et al.

(10) Patent No.: US 12,402,759 B2
(45) Date of Patent: Sep. 2, 2025

(54) DRYING APPARATUS

(71) Applicants: Cindi Weber, Boaz, AL (US); James Weber, Boaz, AL (US)

(72) Inventors: Cindi Weber, Boaz, AL (US); James Weber, Boaz, AL (US)

( * ) Notice: Subject to any disclaimer, the term of this patent is extended or adjusted under 35 U.S.C. 154(b) by 0 days.

(21) Appl. No.: 18/823,077

(22) Filed: Sep. 3, 2024

(65) Prior Publication Data

US 2024/0423421 A1 Dec. 26, 2024

Related U.S. Application Data

(63) Continuation-in-part of application No. 18/208,180, filed on Jun. 9, 2023, now abandoned.

(51) Int. Cl.
*A47K 10/12* (2006.01)
*A47K 10/02* (2006.01)

(52) U.S. Cl.
CPC ..... *A47K 10/02* (2013.01)

(58) Field of Classification Search
CPC ..... A47K 10/02
USPC ..... 34/95
See application file for complete search history.

(56) References Cited

U.S. PATENT DOCUMENTS

2011/0046588 A1* 2/2011 Jensen ..... A61F 13/15 604/385.01

FOREIGN PATENT DOCUMENTS

JP 3119024 B2 * 12/2000
JP 2020062153 A * 4/2020

* cited by examiner

*Primary Examiner* — John P Mccormack
(74) *Attorney, Agent, or Firm* — HULSEY P.C.

(57) ABSTRACT

A drying apparatus of the present disclosure has a drying towel having a first face and a second face. The drying apparatus also has a first handle secured to the first face of the drying towel at or near an end of the drying towel so that a caregiver can grasp the drying towel to dry a disabled person with the second face.

3 Claims, 3 Drawing Sheets

DRYING APPARATUS

CROSS-REFERENCE TO RELATED APPLICATION

This application is a continuation-in-part of and claims priority to Nonprovisional patent application Ser. No. 18/208,180 entitled Drying Apparatus filed on Jun. 9, 2023, which is incorporated herein by reference.

BACKGROUND

Caregivers often have a challenging time giving disabled individuals baths or showers. In this regard, the caregiver must position the person differently to ensure that each part of the disabled person's body is dried. In some instances, the caregiver might find it necessary to hold the disabled person with one hand and towel dry with the other hand. This is difficult to do with a conventional towel.

BRIEF DESCRIPTION OF THE DRAWING FIGURES

DESCRIPTION

The present disclosure relates to a drying towel in accordance with an embodiment of the present disclosure. The exemplary drying towel is rectangular. On one face of the towel is a plurality of handles. Note that the rectangular shape of the towel is for exemplary purposes only. A drying towel in accordance with an embodiment of the present disclosure may be other geometric shapes in other embodiments, e.g., circular, square, triangular, etc. Note that the drying towel can be any size known in the art or future-developed, e.g., 16"×27", 16"×"30", 27"×52", 30"×60", or 35"×60".

Figure 1:
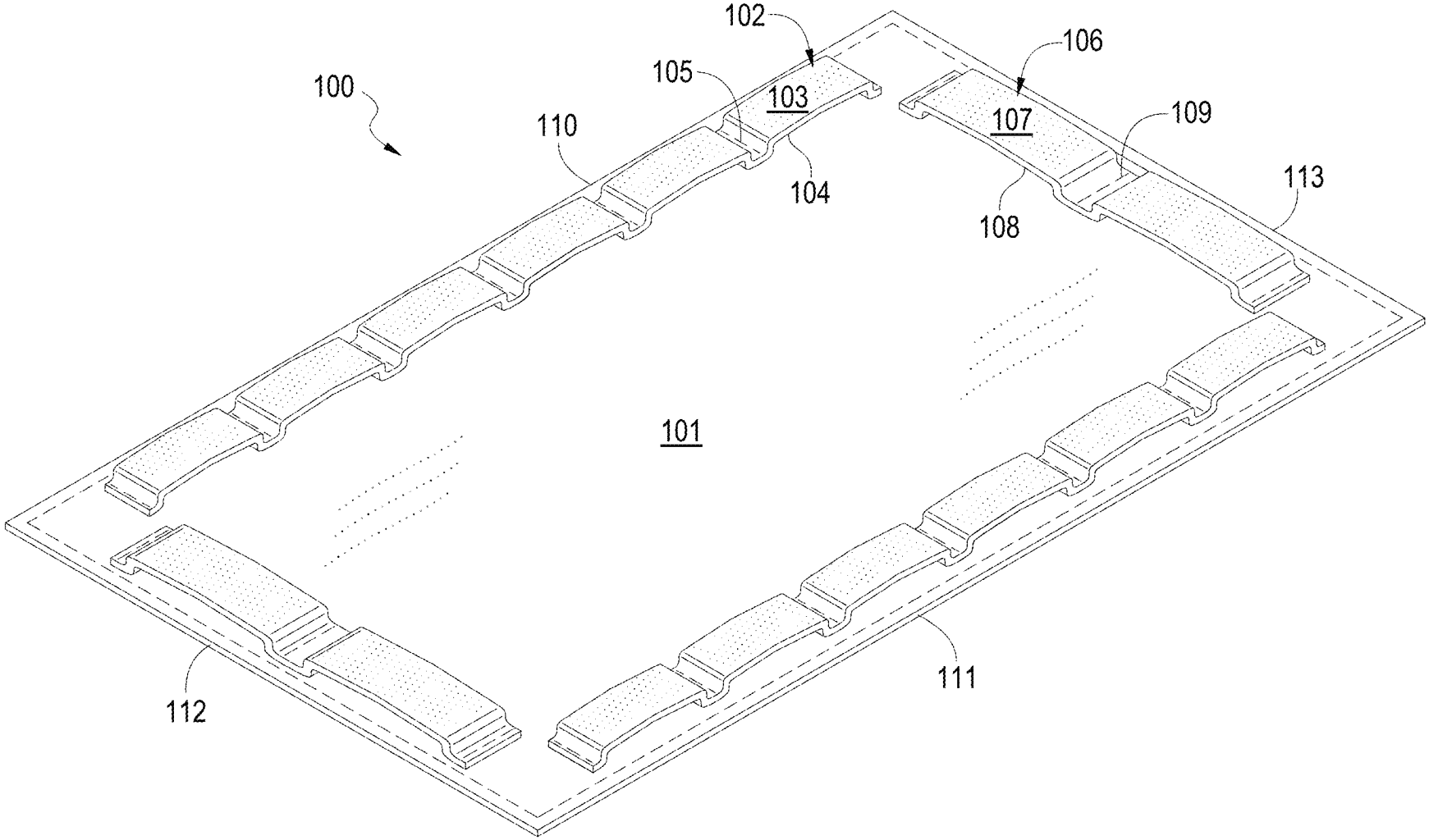
FIG. 1 is a perspective view of a drying towel in accordance with an embodiment of the present disclosure.

FIG. 1 is a perspective view of an exemplary drying towel 100 in accordance with an embodiment of the present disclosure. The exemplary towel 100 is rectangular. However, the exemplary towel 100 may be other geometric shapes in other embodiments, e.g., circular, square, triangular, etc. Further, the drying towel may be many sizes, including but not limited to 16"×27", 16"×"30", 27"×52", 30"×60", or 35"×60".

The exemplary drying towel 100 has long parallel edges 110 and 111. Further, the exemplary drying towel 100 has short parallel edges 112 and 113.

Secured to the drying towel 100 is a plurality of handles 103 and 107. The handles 103 and 107 are secured to a face 101 of the drying towel 100 at or near the edges 110 and 111 and/or 112 and 113, respectively. Securing the handles 103 and 107 at or near the edges 110 and 111 and/or 112 and 113 allows the caregiver full use of the opposite face (not shown) of the drying towel 100 for drying a disabled person. In use, a caregiver may slip his/her hand (not shown) through the handles 103 and 107 to maintain a grasp on the drying towel 100 and to have full use of the face (not shown) of the drying towel 100 opposite the face 101 to which the handles 103 and 107 are secured.

The exemplary drying towel 100 comprises a long rectangular swath of fabric 102 along the long edge 110 of the drying towel 100. The long rectangular swath of fabric 102 is secured to the face 101 of drying towel at regular intervals along the long rectangular swath of fabric 102 via stitches 105.

The stiches 105 form the handle 103. The handle 103 forms an opening 104 in which the caregiver can slip his/her hand.

Note that the exemplary drying towel 100 comprising the long swath of fabric 102 is merely exemplary. The handles 103 may be formed with separate pieces of fabric so that each handle 103 is secured separately to the face 101 of the drying towel 100. Further, while stitching is shown, the handle 103 may be secured to the face 101 of the drying towel 100 via other attachment methods, e.g., fabric glue. Further note that while a plurality of handles is shown, there may be fewer or more handles 103 in other embodiments.

The exemplary drying towel 100 further comprises a short rectangular swath of fabric 106 along the short edge 113 of the drying towel 100. The short rectangular swath of fabric 106 is secured to the face 101 of drying towel at regular intervals along the short rectangular swath of fabric 106 via stitches 109.

The stiches 109 form the handle 107. The handle 107 forms an opening 108 in which the caregiver can slip his/her hand.

Note that the exemplary drying towel 100 comprising the short swath of fabric 106 is merely exemplary. The handle 107 may be formed with separate pieces of fabric so that each handle 107 is secured separately to the face 101 of the drying towel 100. Further, while stitching is shown, the handle 103 may be secured to the face 101 of the drying towel 100 via other attachment methods, e.g., fabric glue. Further note that while a plurality of handles is shown, there may be fewer or more handles 107 in other embodiments.

Figure 2:
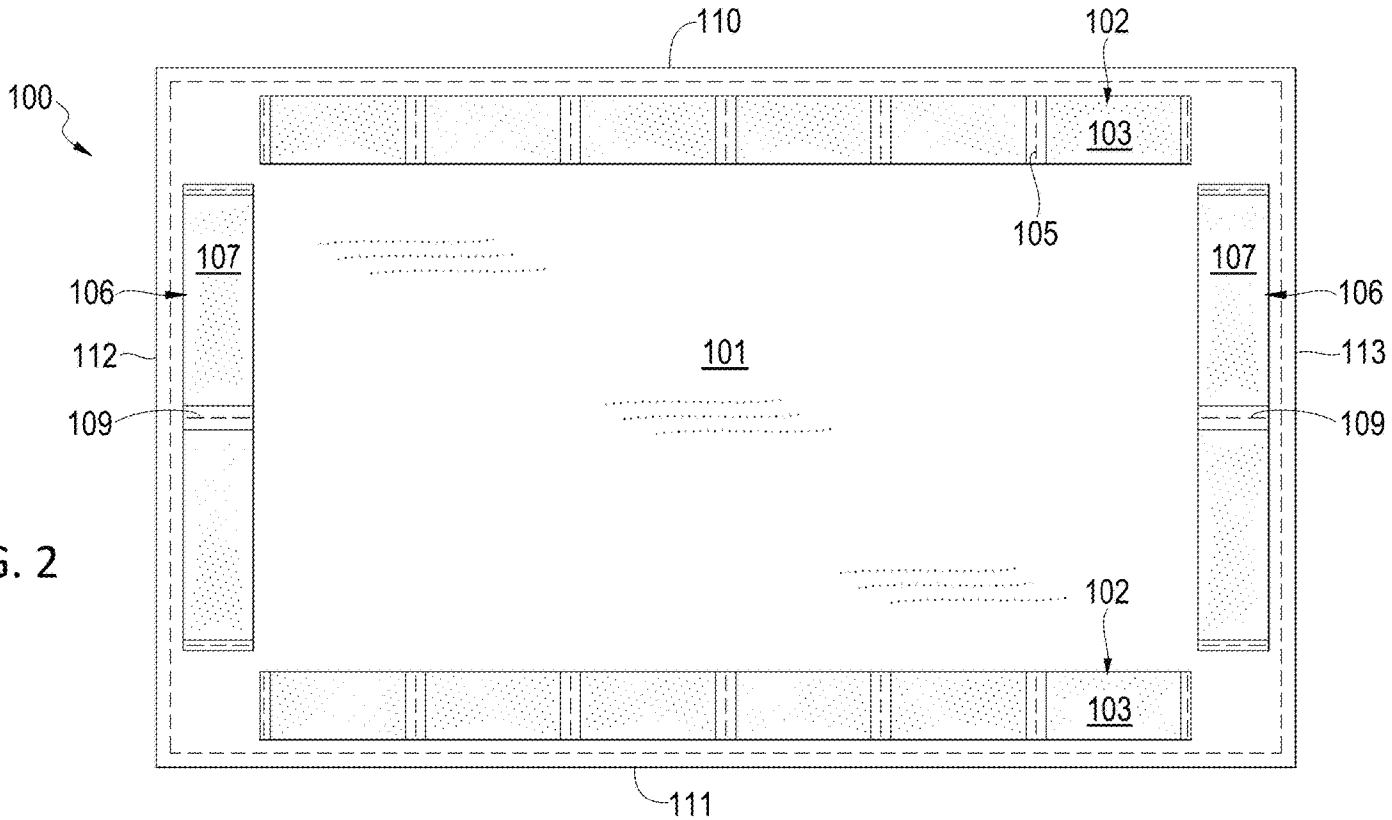
FIG. 2 is a face view of the drying towel as shown in FIG. 1.

FIG. 2 is a top plan view of the exemplary drying towel 100 in accordance with an embodiment of the present disclosure. The drying towel 100 comprises the long edges 110 and 111 and the short edges 112 and 113.

The handles 103 and 107 are secured to the face 101 of the drying towel 100 at or near the edges 110 and 111 and/or 112 and 113, respectively. Securing the handles 103 and 107 at or near the edges 110 and 111 and/or 112 and 113 allows the caregiver full use of the opposite face (not shown) of the drying towel 100 for drying a disabled person. In use, a caregiver may slip his/her hand (not shown) through the handles 103 and 107 to maintain a grasp on the drying towel 100 and to have full use of the face (not shown) of the drying towel 100 opposite the face 101 to which the handles 103 and 107 are secured.

The exemplary drying towel 100 comprises the long rectangular swath of fabric 102 along the long edge 111 of the drying towel 100. The long rectangular swath of fabric 102 is secured to the face 101 of drying towel 100 at regular intervals along the long rectangular swath of fabric 102 via stitches 105 (FIG. 1).

The stiches 105 form the handle 103. The handle 103 forms the opening 104 (FIG. 1) in which the caregiver can slip his/her hand.

The exemplary drying towel 100 comprises the short rectangular swath of fabric 106 along the long edge 113 of the drying towel 100. The short rectangular swath of fabric 106 is secured to the face 101 of drying towel 100 at regular intervals along the short rectangular swath of fabric 106 via stitches 109.

The stiches 109 form the handle 107. The handle 107 forms the opening 108 (FIG. 1) in which the caregiver can slip his/her hand.

Figure 3:
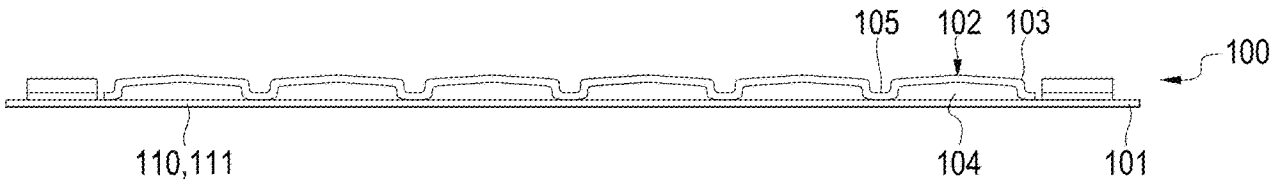
FIG. 3 is a long side view of the drying towel as shown in FIG.

FIG. 3 is a side view of a long side edge 110 or 111 of the drying towel 100. The drying towel 100 comprises the swath of fabric 102 at or near the edge 110 or 111 of the drying towel 100. The swath of fabric 102 is secured to the face 101 of the drying towel 100 via a plurality of stiches 105 at regular intervals.

The stitches 105 form the handle 103. The handle 103 forms the opening 104. The opening 104 receives a caregiver's hand so that the caregiver can easily grasp the drying towel 100 when drying a disabled person (not shown).

As noted above, the drying towel 100 comprising the long swath of fabric 106 is merely exemplary. The handle 107 may be formed with separate pieces of fabric so that each handle 107 is secured separately to the face 101 of the drying towel 100. Further, while stitching is shown, the handle 103 may be secured to the face 101 of the drying towel 100 via other attachment methods, e.g., fabric glue. Further note that while a plurality of handles is shown, there may be fewer or more handles 107 in other embodiments.

Figure 4:
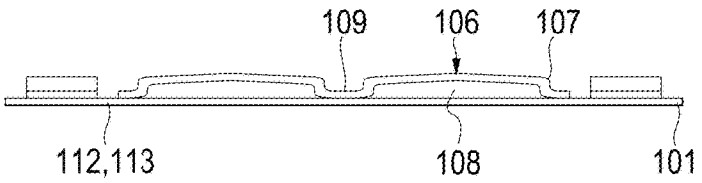
FIG. 4 is a short side view of the drying towel as shown in FIG. 1.

FIG. 4 is a side view of a short side edge 112 or 113 of the drying towel 100. The drying towel 100 comprises the swath of fabric 106 at or near the edge 112 and/or 113 of the drying towel 100. The swath of fabric 106 is secured to the face 101 of the drying towel 100 via the plurality of stiches 109 at regular intervals.

The stitches 109 form the handle 107. The handle 107 forms the opening 108. The opening 108 receives a caregiver's hand so that the caregiver can easily grasp the drying towel 100 when drying a disabled person (not shown).

As noted above, the drying towel 100 comprising the short swath of fabric 106 is merely exemplary. The handle 107 may be formed with separate pieces of fabric so that each handle 107 is secured separately to the face 101 of the drying towel 100. Further, while stitching is shown, the handle 103 may be secured to the face 101 of the drying towel 100 via other attachment methods, e.g., fabric glue. Further note that while a plurality of handles is shown, there may be fewer or more handles 107 in other embodiments. Also note that handles 103 and 107 are shown along the long edges 110 and 111 and the short edges 112 and 113. While handles 103 and 107 are shown along all four edges 110, 111, 112, and 113, handles 103 and 107 may be secured along only one edge, two edges, or three edges in other embodiments.

Figure 5:
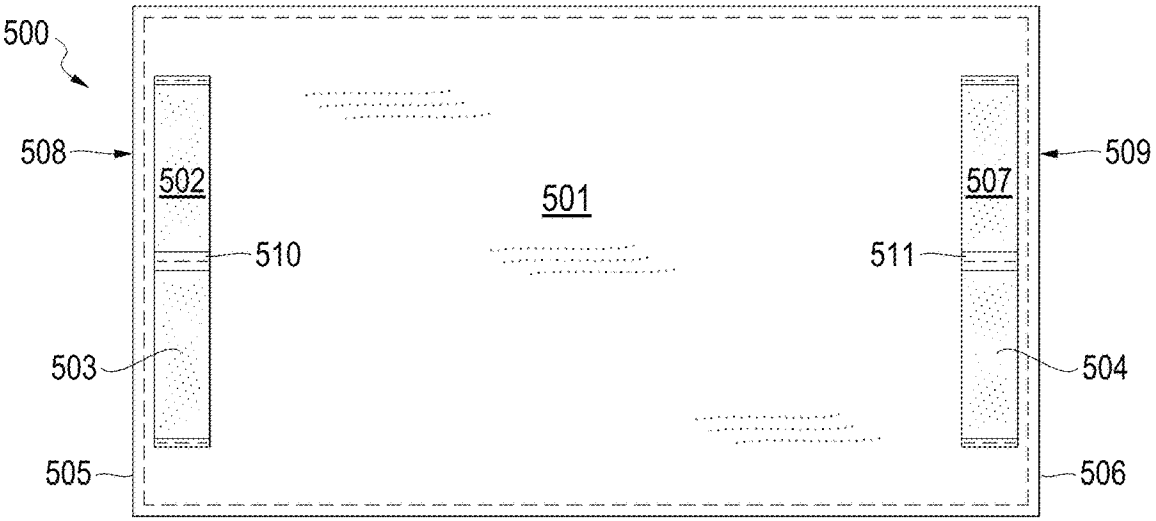
FIG. 5 is a face view of a drying towel having handles on a short end of the drying towel in accordance with another embodiment of the present disclosure.

FIG. 5 is a top view of another embodiment of an exemplary towel 500 in accordance with an embodiment of the present disclosure. In such an embodiment, the towel 500 comprises handles 503 and 504 at each short end of the towel 500. The handles 503 and 504 are secured to the face 501 of the drying towel 500 at or near the edges 505 and 506, respectively. Securing the handles 503 and 504 at or near the edges 505 and 506 allows the caregiver full use of the opposite face (not shown) of the drying towel 500 for drying a disabled person. In use, a caregiver may slip his/her hand (not shown) through the handles 503 and 504 to maintain a grasp on the drying towel 500 and to have full use of the face (not shown) of the drying towel 500 opposite the face 501 to which the handles 503 and 504 are secured.

In one embodiment, the exemplary drying towel 500 comprises rectangular swaths of fabric 502 and 507 along the edges 505 and 504, respectively, of the drying towel 500. The rectangular swaths of fabric 502 and 507 are secured to the face 501 of drying towel 500 at regular intervals along the short ends 508 and 509 of the face 501 via stitches 510 and 511, respectively.

The stiches 510 and 511 form the handles 503 and 504. The handles 503 and 504 form openings like those openings 104 (FIG. 1) in which the caregiver can slip his/her hand.

Figure 6:
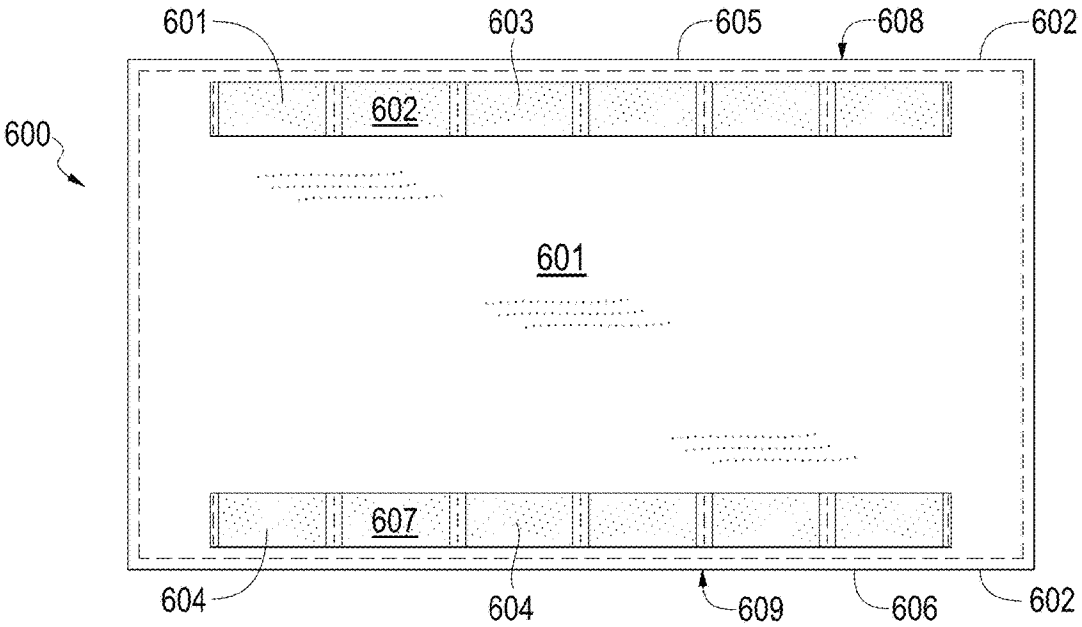
FIG. 6 is a face view of a drying towel having handles on a long end of the drying towel in accordance with another embodiment of the present disclosure.

FIG. 6 is a top view of another embodiment of an exemplary towel 600 in accordance with an embodiment of the present disclosure. In such an embodiment, the towel 600 comprises handles 603 and 604 at the long ends 608 and 609 of the towel 600. The handles 603 and 604 are secured to the face 601 of the drying towel 600 at or near the edges 605 and 606, respectively. Securing the handles 603 and 604 at or near the edges 608 and 609 allows the caregiver full use of the opposite face (not shown) of the drying towel 600 for drying a disabled person. In use, a caregiver may slip his/her hand (not shown) through the handles 603 and 604 to maintain a grasp on the drying towel 600 and to have full use of the face (not shown) of the drying towel 600 opposite the face 601 to which the handles 603 and 604 are secured.

In one embodiment, the exemplary drying towel 600 comprises long rectangular swaths of fabric 602 and 607 along the long edges 605 and 606, respectively, of the drying towel 600. The long rectangular swaths of fabric 602 and 607 are secured to the face 601 of drying towel 600 at regular intervals along the long ends 608 and 609 of the face 601 via stitches 610 and 611.

The stiches 610 and 611 form the handles 603 and 604. The handles 603 and 604 form openings like those openings 104 (FIG. 1) in which the caregiver can slip his/her hand.

What we claim is:

1. A drying apparatus, comprising:

a drying towel having a first face and a second face opposite the first face; and a plurality of handles positioned on each end of the first face, wherein each handle of the plurality of handles extending from and being secured to the first face of the drying towel, wherein each handle defines an opening, with the first face of the drying towel, through which a caregiver can insert a hand to grasp the drying towel, thereby allowing the second face to dry a disabled person.

2. The drying apparatus of claim 1, wherein the plurality of handles is secured to the first face at regular intervals via stitches.

3. The drying apparatus of claim 1, wherein each handle comprises a swath of fabric secured to the first face via stitches.

* * * * *